US008733752B2

(12) United States Patent
Heiniger

(10) Patent No.: US 8,733,752 B2
(45) Date of Patent: May 27, 2014

(54) APPARATUS AND METHOD FOR PRODUCING PACKS OF FLEXIBLE FLAT OBJECTS

(75) Inventor: Reto Heiniger, Feldbach (CH)

(73) Assignee: Ferag AG, Hinwil (CH)

( * ) Notice: Subject to any disclaimer, the term of this patent is extended or adjusted under 35 U.S.C. 154(b) by 370 days.

(21) Appl. No.: 13/134,786

(22) Filed: Jun. 15, 2011

(65) Prior Publication Data

US 2011/0303107 A1 Dec. 15, 2011

(30) Foreign Application Priority Data

Jun. 15, 2010 (CH) ..... 958/10

(51) Int. Cl.
*B65H 33/00* (2006.01)
*B65H 33/12* (2006.01)
*B65H 33/16* (2006.01)

(52) U.S. Cl.
USPC ..... 270/52.19; 270/52.14; 270/52.2; 270/52.22; 270/58.23

(58) Field of Classification Search
USPC ..... 270/52.14, 52.19, 52.2, 52.21, 52.22, 270/1.01, 58.18, 58.23, 58.2; 101/236, 238, 101/240; 271/9.01, 176
See application file for complete search history.

(56) References Cited

U.S. PATENT DOCUMENTS 5,727,781 A * 3/1998 Muller ..... 270/58.23
6,257,566 B1 * 7/2001 Dooley ..... 270/52.18
6,311,104 B1 * 10/2001 Shea et al. ..... 700/222
6,446,953 B1 * 9/2002 Felix et al. ..... 270/52.19
6,690,996 B2 * 2/2004 Seiler ..... 700/228
7,281,709 B2 * 10/2007 Honegger ..... 271/9.01
7,665,720 B2 * 2/2010 Mori et al. ..... 270/52.16
7,862,019 B2 * 1/2011 Belanger ..... 270/52.15
7,997,573 B2 * 8/2011 Langenegger ..... 270/52.18

FOREIGN PATENT DOCUMENTS

DE 195 24 912 A1 2/1996
DE 10 2008 033 184 A1 3/2010
EP 1101 723 5/2001
EP 1 112 864 A2 7/2001
EP 1 302 418 4/2003
EP 1 475 329 A1 11/2004
EP 1 935 821 A1 6/2008
EP 2 110 356 A2 10/2009
WO WO 2010/051651 A2 5/2010

* cited by examiner

*Primary Examiner* — Leslie A Nicholson, III
(74) *Attorney, Agent, or Firm* — Pauly Petersen & Erickson

(57) ABSTRACT

The invention proposes a method for operating a print further processing system for producing and processing printed products, in particular for forming stacks or packs of printed product collections comprising completed final printed products such as periodicals and newspapers, which are preferably put together from a main product and a plurality of part products and/or inserts. The printed products are produced in accordance with a predefined production plan and, by means of a stacking device, are processed to form a sequence of packs (S1-S9) of individually predefined size; in order to produce part packs, the processing speed of the parts of the print further processing system that are connected upstream of the stacking device is reduced and, when a threshold value (T) is exceeded, empty positions are formed deliberately in the section of the product sequence allocated to the pack (S). The threshold value (T) is preferably a predefined value of the difference Δ in the size of successive packs (Sn−Sn+1).

16 Claims, 6 Drawing Sheets

APPARATUS AND METHOD FOR PRODUCING PACKS OF FLEXIBLE FLAT OBJECTS

CROSS REFERENCE TO RELATED APPLICATION

Swiss Patent Reference 0958/10, filed 15 Jun. 2010, the priority document corresponding to this invention, and its teachings are incorporated, by reference, into this specification.

BACKGROUND OF THE INVENTION

1. Field of the Invention

The invention relates to a method for operating a print further processing system for producing and processing printed products, in particular for forming stacks or packs of printed product collections comprising completed final printed products such as periodicals and newspapers, which are preferably put together from a main product and a plurality of part products and/or inserts. The present invention relates, furthermore, to a print further processing system for implementing the method.

With the increasing regionalization or individualization of products, higher and higher requirements are being placed on print further processing. On the one hand, in order to increase profitability, processing capacities have to be increased in step with the increased capacities of the rotary system, on the other hand it must also be possible to make the products without difficulty finished and ready to ship for extremely small zones. The smaller the zones, which means regions with the same collection (for example main and part products with zone-specific advertising inserts, official notices and/or references to events), the more part packs, which means packs comprising a few products, have to be processed. Since the processing cycle in the case of the known stacking apparatuses, binders and so on cannot be reduced below a cycle time of currently about 2 seconds, exactly the same amount of time is needed for the production of a pack having a few printed products or collections of printed products as for a complete pack with the complete number of printed products or collections which, depending on the thickness of the printed products or collections, can be around 20 to 40 or more. The more small stacks or packs have to be formed, the more inefficiently the known systems for print further processing operate.

2. Discussion of Related Art

EP 1 935 821 A1 discloses a method for forming stacks from print shop products, such as in particular books, periodicals, newspapers, brochures or similar products, which are produced industrially on production lines. Such production lines are formed by individual machines arranged serially one after another and coupled to one another, each of these individual machines having a maximum production speed depending on the product parameters and production conditions. In EP 1 935 821 A1, it is described as disadvantageous that the maximum possible production speed of the overall production lines according to the prior art is therefore limited by the machine having the lowest maximum speed. It is viewed as a particularly difficult situation if product parameters which have an influence on the maximum production speed of the machine that limits the maximum production speed of the production line change continuously during the production. This may be the case, for example, in a stacking apparatus which is intended to form stacks of different size, depending on the order quantities of various recipients. To this end, it is explained that, for one stacking apparatus, there are two upper production limits which cannot be exceeded. The first limit relates to the maximum possible rate at which the printed products can be accepted by the stacking apparatus. The second limit relates to the maximum possible rate or the minimum possible cycle time during which stacks can be conveyed out of the stacking apparatus.

In EP 1 935 821 A1, on the basis of the finding that the maximum possible feed rate is a multiple of the maximum possible output delivery rate, it is concluded that it is not possible to form any smaller stacks than the ratio, rounded to the nearest whole number, of the maximum possible feed rate divided by the maximum possible output delivery rate. According to a first prior art, provision is made to solve the problem by the printed products being distributed by means of a distribution device to a plurality of stacking apparatuses arranged in parallel and the stacks then being combined again into one line. With sufficiently many stacking apparatuses, it should be possible at any time to process the full production output of the remaining line. However, it is assumed that the great requirement for machines, the additional space required and the worsened accessibility to the individual stacking apparatuses arranged in parallel would be disadvantageous.

In order to avoid these disadvantages and in order to avoid distribution to a plurality of stacking apparatuses arranged in parallel, EP 1 935 821 A1 proposes a method for forming stacks from printed products in which the printed sheets fed in from a plurality along a single conveying section and collated on the latter to form pre-products are then processed into stacks in a single stacking apparatus, the procedure for collating the printed sheets to form pre-products being controlled as a function of the size of the stack of printed products to be formed. This procedure of collating printed sheets to form pre-products is necessarily interrupted when a stack size determined by the number of printed products is undershot, the stack size leading to the interruption to the procedure being determined from the product of the number of cycles of the collating procedure and the minimum cycle time for forming a stack. In a known way, therefore, the knowledge of the maximum processing throughput of the stacking apparatus is utilized in order to trigger a control step when it is exceeded.

Irrespective of the size of the stacks to be formed in the stacking apparatus, the production speed in the production line is kept constantly high. However, the production throughput of the overall production line is still reduced during the formation of small stacks in the stacking apparatus since, although a fluctuation or continuous change in the speed in the production line can be avoided, the overall throughput in this method also has to be reduced to such an extent that there is sufficient time available for the delivery of the stacks. If a disruption or an interruption in the operation of the stacking apparatus occurs, then the throughput of the entire production line has to be reduced to zero.

SUMMARY OF THE INVENTION

It is therefore an object of the present invention to offer an improved operating method with one, two or more stacking apparatuses which makes it possible for large numbers of printed products and/or collections to be put together with the highest possible system efficiency to form stacks or packs, so that the production of small stacks or packs (what are known as part packs) and the overall throughput of a print further processing system can be optimized even in the case of a high level of individualization or regionalization. At the same time, the high net throughput is to be achieved with the lowest possible energy consumption and with reduced system wear.

It is a further object of the present invention to propose an apparatus and a method for controlling the feeding of printed products to stacking apparatuses which do not exhibit at least some disadvantages of the known apparatuses and methods. It is in particular an object of the present invention to provide an apparatus and a method for controlling a print further processing system which comprise at least one conveyor for feeding printed products to collating apparatuses, the collating apparatuses being connected upstream of stacking apparatuses.

According to the present invention, these objectives are achieved by the elements of the independent claims. Further advantageous embodiments additionally emerge from the dependent claims and the description.

The aforementioned objectives are achieved by the present invention in particular in that, by varying the operating speed of the print further processing system in accordance with a predefined production plan, the printed products to be processed are put together to form a sequence of products and/or collections to be produced and these are processed to form stacks (also called packs below) with an individually predefined size.

On the basis of the previously defined production plan and the maximum pack size, which means the number of products and/or collections in a pack, a pack sequence is calculated for the stacking apparatus. The production plan comprises the information about the type and number of collections in each pack and the sequence of packs for shipping, for loading or for intermediate storage. Once more on the basis of the pack sequence, the difference in the size (i.e. in the number of collections in a pack) of the successive packs in the sequence is determined. If the number of collections in a following pack decreases then, by reducing the production speed in the further processing system of the stacking apparatus, the necessary time is created in order to produce the stack of reduced size. If this difference value exceeds a predefined threshold value, empty positions are deliberately formed in the section of the product sequence allocated to the pack for the purpose of additionally relieving the load on the stacking apparatus, or rather to adapt to the processing capacity.

In general, to achieve a high system efficiency, the variation in the operating speed should preferably be achieved with a minimum of speed reduction and acceleration, that is to say with very shallowly formed ramps. As a result of the deliberate formation of gaps in the product sequence, an energy-optimized alternative to sharp variations in speed is available, which permits sharp braking and acceleration to be avoided. The system is preferably not braked actively for the purpose of speed reduction; instead the continuous energy losses of the moving machine components as a result of friction are used to reduce the speed. In the process, the system is controlled in such away that, preferably, as much energy as possible is left in the system. The high mechanical loading on individual parts of the system as a result of the deliberate formation of gaps is balanced against the energy consumption as a result of severe speed variations.

It is known that, in the event of an emergency stop, generically identical systems for print further processing have to come to a standstill within about one (1) second from operation at the highest processing speed and, respectively, the highest throughput. In a graph in which the throughput in items/collections is plotted against time, the emergency stop constitutes the steepest ramp downwards. During such an emergency stop, however, it is not always possible to run down all the parts of the system in a coordinated manner. This necessitates additional effort to synchronize all the parts of the system when starting up again after an emergency stop. When running down the further processing system specifically, the processing speed can be reduced from the maximum to zero within a few seconds without the individual parts of the system losing synchronism. With this negative acceleration, the processing speed can be reduced at a maximum rate in order to relieve the load on the stacking device for the production of part packs, without synchronism being lost in the system. If the production of individual part packs requires a more severe reduction in speed, according to the present invention, empty positions are deliberately introduced into the product stream. The product throughput can therefore be reduced further without the system speed decreasing further. The superimposition of these two measures therefore makes it possible to relieve the load-on a stacking device for producing extremely small part packs without loading the system mechanically highly, instead maintaining harmonious system operation.

The previously defined production plan is optimized towards the packs being produced in such a way in terms of their composition, size and order that they can be loaded onto a transport vehicle in the reverse of the order in which they are unloaded along a distribution route.

According to the present invention, use is made of at least one stacking device but, in advantageous embodiments, also of more stacking devices. When two or more stacking devices are used, it has proven to be advantageous, on the basis of the previously defined production plan and the maximum pack size, which means the number of collections in a pack which permit maximum efficiency during the operation of the stacking device, to calculate a separate product sequence for each stacking apparatus. In these embodiments, the production plan not only comprises the information about the type and number of collections in each pack and the sequence of the packs for shipping, for loading or for intermediate storage, but in addition also the information as to the stacking device to which a collection is assigned.

In systems with more than one stacking device, at least one stacking device is preferably provided for processing part and standard packs, the remaining stacking devices preferably producing packs with the desired maximum standard size. Therefore, at least one stacking apparatus is "used" in order to produce part and standard packs with a reduced net throughput. These are opposed to those stacking apparatuses which produce packs with the desired standard size with high efficiency. In the system for print further processing according to the invention, a collating apparatus is preferably connected upstream of the at least one stacking device for processing part packs.

At least one collating apparatus is also connected upstream of the stacking apparatuses that produce packs of the desired standard size with maximum utilization. By means of a feed conveyor upstream, preferably a circulator, all the collating apparatuses can preferably be supplied with main products and inserted pre-products in synchronism with the cycle rate. Main and pre-products originate from a further part of the system, once more connected upstream, for example an insertion drum, in which a desired number of pre-products are inserted into a main product. In off-line operation, main and pre-products are fed from storage devices to the insertion drum by means of suitable feed conveyors, for example a known cyclic feeder (German "Lagentakter") from the Applicant.

On the basis of the predefined production plan, in a computerized higher-order control device, a superimposed product sequence is calculated which distributes all of the number of end products or collections to be produced to a minimum number of packs, taking account of the stipulations from the production plan. In order to produce packs which do not reach the maximum pack size—what are known as part packs—the system speed is reduced to such an extent that sufficient time remains for the stacking device to produce the part pack. To this end, the difference Δ in the size or product number between a preceding pack and a following pack is calculated. If Δ exceeds a specific predefined value, then the system cannot be slowed quickly enough, that is to say to the desired lower speed, in the time window provided, to permit the part pack production. In such a case, on the basis of the production plan, empty positions have previously been introduced into the product stream, so that as a result of the slowing of the print further processing system connected upstream of the stacking device and by means of the empty positions inserted deliberately into the product stream within the time interval needed by the stacking device at least to produce one pack, only the desired low number of products or collections is supplied. The computerized control device generates a product sequence which comprises the number and order of the empty positions between the end products or collections corresponding to the packs to be produced.

If the print further processing system has two or more stacking devices, then all these devices can be operated in accordance with the method described previously. According to preferred embodiments, however, a stacking device can also be allocated the processing of part and standard packs. The packs which reach the maximum pack size—which means what are known as the standard packs—are accordingly allocated to one or more stacking devices for processing standard packs. At least for each stacking device, the computerized control device generates a product sequence which corresponds to the number and order of the end products or collections in the packs to be produced. These individual product sequences are combined in accordance with the order of the stacking devices or the collating apparatuses connected upstream thereof to form a superimposed product sequence, in which the products of the individual product sequences follow one another alternately. The individual product sequences are, so to speak, dovetailed or interleaved in one another.

For instance, if three stacking apparatuses and, respectively, three collating apparatuses connected upstream have to be supplied with products, then a superimposed product sequence is generated in which each third product is assigned to the same stacking apparatus and, respectively, to the same collating apparatuses connected upstream. This unambiguous assignment makes it possible to operate all the substantial parts of the system synchronously, depending on the size of the part packs, not all the cycle positions in the product sequence of the stacking apparatus being occupied with products for the production of the part packs. By virtue of the superimposed product sequence, a single product stream which comprises the product sequences for standard and part packs interleaved in one another can be formed in the print further processing system according to the invention and processed with the same parts of the system. Splitting of the product streams is preferably carried out only before they are fed to the stacking apparatuses or the collating apparatuses connected upstream of the latter. This makes it possible to use the parts of the system with maximum efficiency, since the product streams for the production of normal and part packs are divided up only when this is absolutely necessary.

According to a further embodiment of the method of the invention, a collating apparatus which has the ability to feed back the products is connected upstream of the at least one stacking device. Such apparatuses are known from the Applicant under the trade name Flystream and are generically similarly disclosed, for example in the Laid-open specification WO2010/051651 A2. These collating apparatuses make it possible to produce collections of printed products and inserts along a collating section, inserts also being understood to mean cards, product samples, CD-ROMs, DVDs and the like. Collating is not carried out on a circulating belt but on an upper run of a conveying device having a large number of holders, in which the products can be held in a clamping manner, so that the collections do not necessarily have to be discharged or separated out at the end of the collating section but can be held and led back to the start of the collating section in a lower run. In the known systems, this functionality is advantageously used to complete incomplete product collections. According to the present invention, it is advantageously used to create additional time for the at least one stacking apparatus connected downstream to produce a part pack by means of the controlled non-discharge of a product collection, which means as a result of generating one or more empty positions in the product stream which is discharged from the collating device.

Feeding back product collections in the collating apparatus has to be taken into account in the product sequence. It leads to the order of the products which are fed to the collating apparatus not corresponding to the order of the products/product collections in the part packs produced from the latter.

After passing through the collating section, according to preferred embodiments, the collated product collections are sealed in film, transferred to deliverers, for example in the form of circulating chain conveyors with grippers, and fed by the latter to the stacking apparatus or apparatuses. Each of the deliverers is able to supply one or more stacking apparatuses with product collections. In order to increase the flexibility of the print further processing systems, individual stacking apparatuses can also be supplied with product collections by a plurality of deliverers, which means, for example, by a plurality of collating apparatuses.

In a way similar to that described previously by using the collating apparatus of the Flystream type, the deliverer which feeds the completed product collections to the stacking apparatus can also be operated in such a way that individual product collections or a plurality of product collections are not discharged to the stacking apparatus or separated out in an overflow connected downstream, but rather are held and led back to the start of the delivery section. According to the present invention, it is advantageously used in turn to give the at least one stacking apparatus downstream sufficient time to produce part packs, by means of generating empty product positions. The higher-order control system knows the corresponding positions in the deliverer which are already occupied with non-discharged collections fed back and already takes these occupied positions into account in advance in the steps to be carried out upstream for producing the superimposed product sequence by means of the insertion of corresponding empty cycle positions which, downstream, ensure that a product collection that is fed back does not collide with a new product collection to be delivered.

The determination of a stacking apparatus as a stacking apparatus for producing part packs in a print further processing system having a plurality of stacking apparatuses can be carried out dynamically, according to further advantageous embodiments. This means that a specific stacking device does not necessarily have to function over an entire production cycle—i.e. during the processing of a complete production plan—as a stacking apparatus for producing part packs. If no part packs are needed in specific phases of the production, then standard packs are produced on this stacking apparatus without difficulty and without any kind of conversion steps. In a way analogous to this, when there is a high demand for part packs, a stacking apparatus which has previously produced standard packs can at any time be used dynamically for the production of part packs. A sequential combination of the production of part and standard packs on the same apparatus is possible.

This high level of flexibility is made possible by the superimposed product sequence, which is generated upstream and, whilst maintaining a predefined cycle rate, permits the allocation of stacking apparatus-specific product sequences b means of deliberate removal from the superimposed product-sequence downstream.

As already mentioned previously, each of the deliverers is preferably equipped with an overflow downstream of the stacking apparatuses supplied thereby, into which overflow excess product collections or those which cannot currently be processed can be discharged.

Depending on the application and thickness of the products, a plurality of feed conveyor devices in a collating apparatus are occupied by the same product (split operation). This has been found worthwhile, for example in the case of thick products, of which in each case there is room for only a small number in the magazine shaft of a feed conveyor device, and manual refilling is too slow in order to ensure, at high processing speeds, the interruption-free feeding of products into the holders of the collating apparatus by means of a single feed conveyor device.

According to the present invention, the important parts of the system are connected to a higher-order computerized control system. In principle, it is true that these connections can be formed in a wire-bound or line-bound or wire-free or line-free manner. Wire-free or line-free connections can be produced in accordance with the local situation, for example by means of a radio connection between the control system and the respective parts of the system. All the important parts of the system are preferably connected indirectly or directly to the higher-order computerized control system. For the implementation of the method according to the invention, however, in the simplest case it is sufficient for the desired superimposed product sequence to be generated in accordance with the production plan at the start of the print further processing. The following processing steps and, respectively, the apparatuses and parts of the system involved therein can be controlled locally in further embodiments, without any direct contact with the higher-order control system.

BRIEF DESCRIPTION OF THE DRAWINGS

The invention will be explained below by using figures, which merely represent exemplary embodiments and in which.

DESCRIPTION OF PREFERRED EMBODIMENTS

Figure 1:
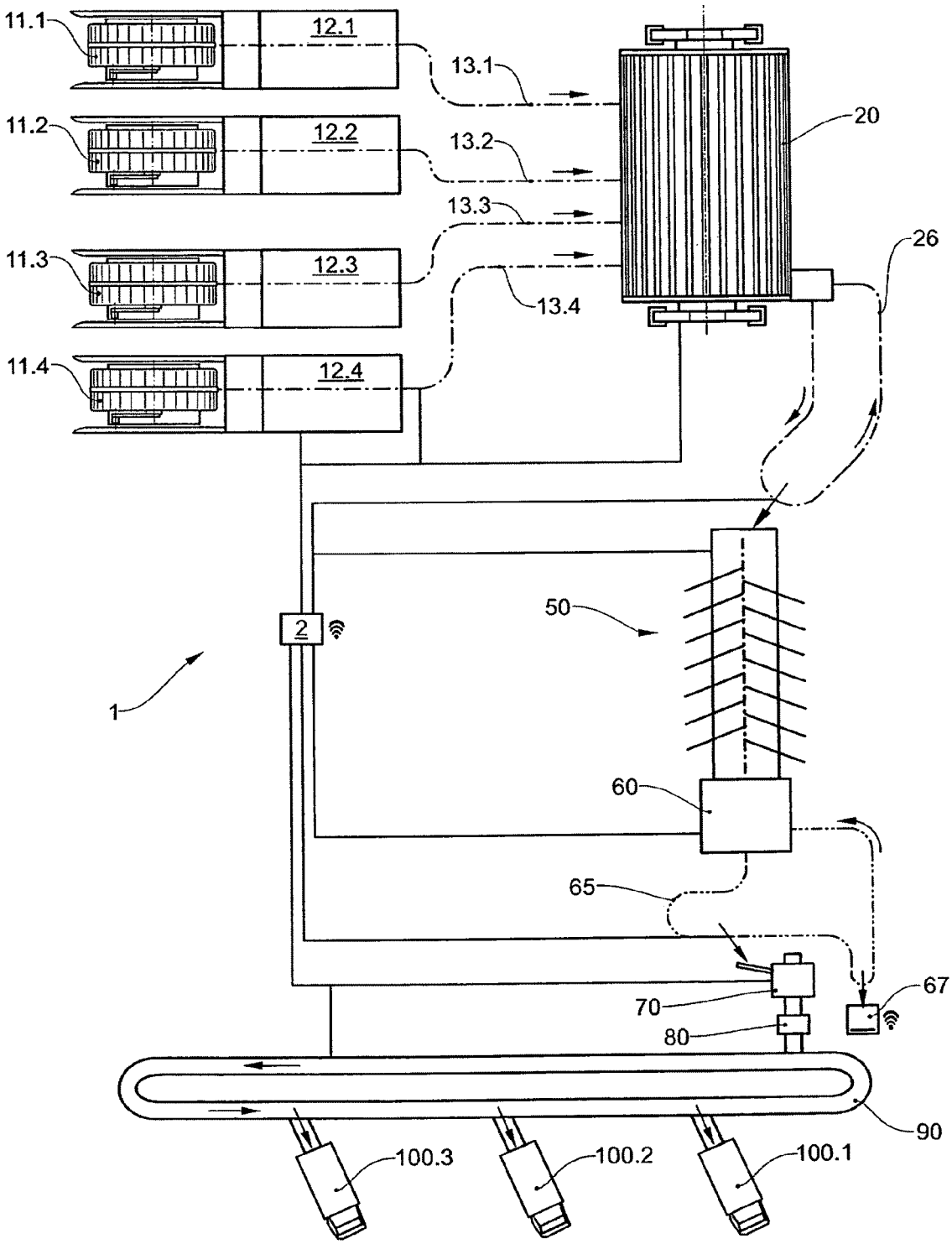
FIG. 1 shows a highly schematic view of a print further processing system according to a first embodiment.

FIG. 1 illustrates an embodiment of a print further processing system 1 according to the invention, in which an insertion drum 20 is supplied via four feed conveyors 13.1 to 13.4 with a main product and three pre-products. In the insertion drum 20 downstream, three pre-products from the storage drums 11.2, 11.3 and 11.4 are inserted into the main product, which, in off-line operation, is fed to the insertion drum from a storage drum 11.1 via a cyclic feeder 12.1 and the feed conveyor 13.1. This procedure is carried out in a known way in synchronism with the higher-order system cycle rate. Those skilled in the art know how, by means of various system components, more complex printed products can be produced which comprise more pre-products and/or inserts, which are bonded or stitched or are stuck into the cards, DVDs or the like. The printed products produced in the insertion drum 20 are delivered via a gripper conveyor 26 and transported to a collating apparatus 50. In the collating apparatus 50, further pre-products or inserts can be deposited on the printed products via a plurality of feed conveyor devices, and in this way collections can be collated. The collections are preferably sealed in film in a film-wrapping station 60 connected downstream and transported by a further gripper conveyor 65 to a downstream stacking apparatus 70. The deliverer 65 is equipped, downstream of the stacking apparatus 70 supplied by it, with an overflow 67, into which excess or faulty product collections or those which cannot currently be processed can be discharged.

The stacks of end products or product collections produced in the stacking apparatus 70 are tied up or banded to form packs in a binder 80 connected directly downstream of the stacking apparatus 70. They are then discharged onto a circulating pack transporter 90, which brings them to the transport vehicles 100.1, 100.2 and 100.3 provided in accordance with the production plan.

The conveying directions of the products, product collections and/or packs in the respective parts of the system and apparatuses according to FIG. 1, but also in the further figures, are in each case indicated by arrows.

Figure 2A:
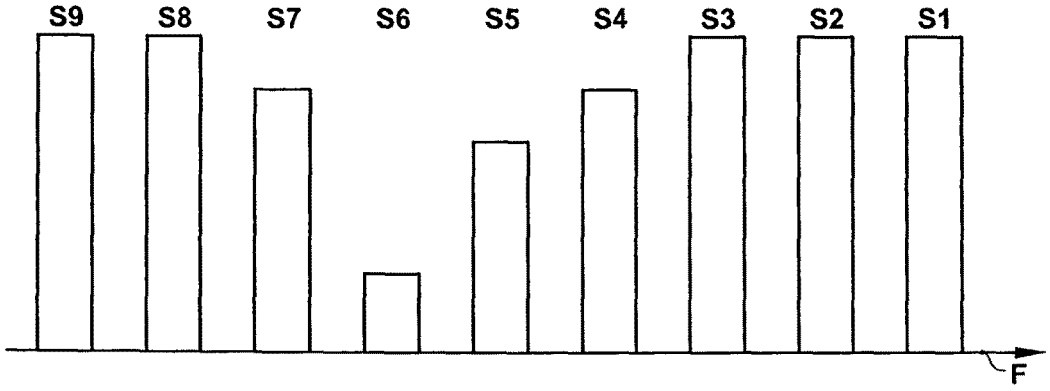
FIG. 2*a* shows a sequence, illustrated schematically in bar form, of product stacks of various size according to a first example.
Figure 2B:
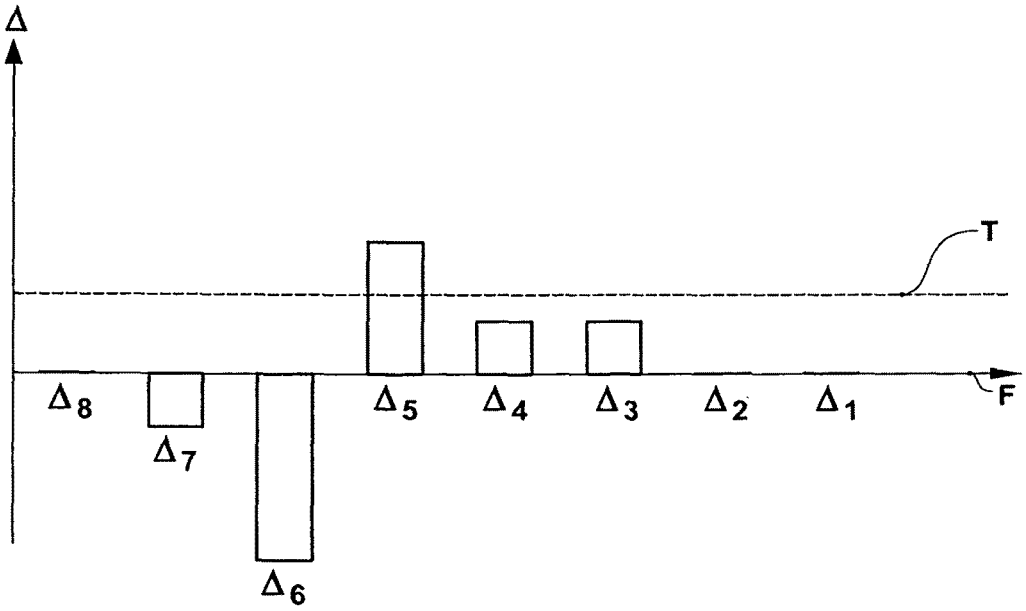
FIG. 2*b* shows a graph of the size differences Δ between successive stacks according to FIG. 2*a*, a threshold value being shown dashed.

FIG. 2*a* illustrates a sequence of product stacks S1 to S9 of various size according to a first example, schematically in bar form. In the associated graph of FIG. 2*b*, the size differences Δ1 to Δ8 between the successive stacks S1 to S9 are plotted. Since the stacks S1 to S3 and S8 and S9 are of standard size, the values Δ1, Δ2 and Δ8 are in each case zero. Since the preceding stack S3 is two products larger than the immediately following stack S4, Δ3 has the positive value 2.

Stack S5 is once more two products smaller than stack 4, so that Δ4 once more has the positive value 2. In order not to overload the stacking device and to avoid the removal of collections as rejects, before processing stack S4 the system speed is reduced to such an extent that the stacking device has sufficient time available to produce the smaller stack 4. Before processing stack S5, the system speed is reduced once more, so that the stacking device has sufficient time available to process the collections, now supplied at a reduced speed, to form stack 5. Stack S6 comprises only three product collections and is therefore 5 products smaller than S5, so that Δ5 assumes the value 5, and exceeds the predefined threshold value T, which is shown dashed. This means that the change Δ in the stack size can no longer be compensated for by a further synchronous reduction in the production speed within a stacking cycle without the upstream parts of the print further processing system 1 running the risk of losing the system cycle rate as a result of the delay. When the threshold value T is exceeded, the relief of the load on the stacking device 70 is no longer implemented merely by further slowing the upstream parts of the system 10, 12, 13, 20, 26, 50, 60 and 65, instead empty positions are generated in the product stream.

Figure 3A:
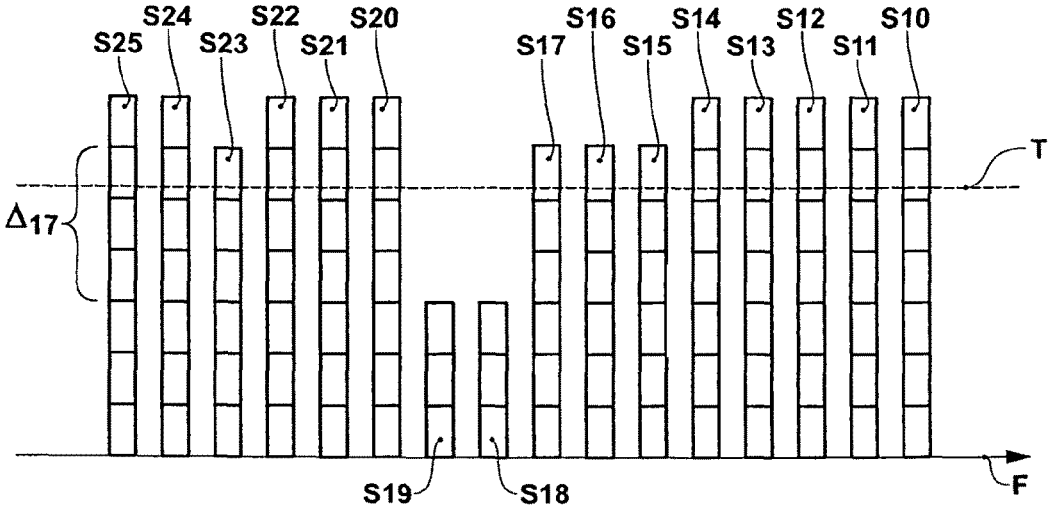
FIG. 3*a* shows a sequence, illustrated schematically in bar form, of product stacks of various size according to a further example.
Figure 3B:
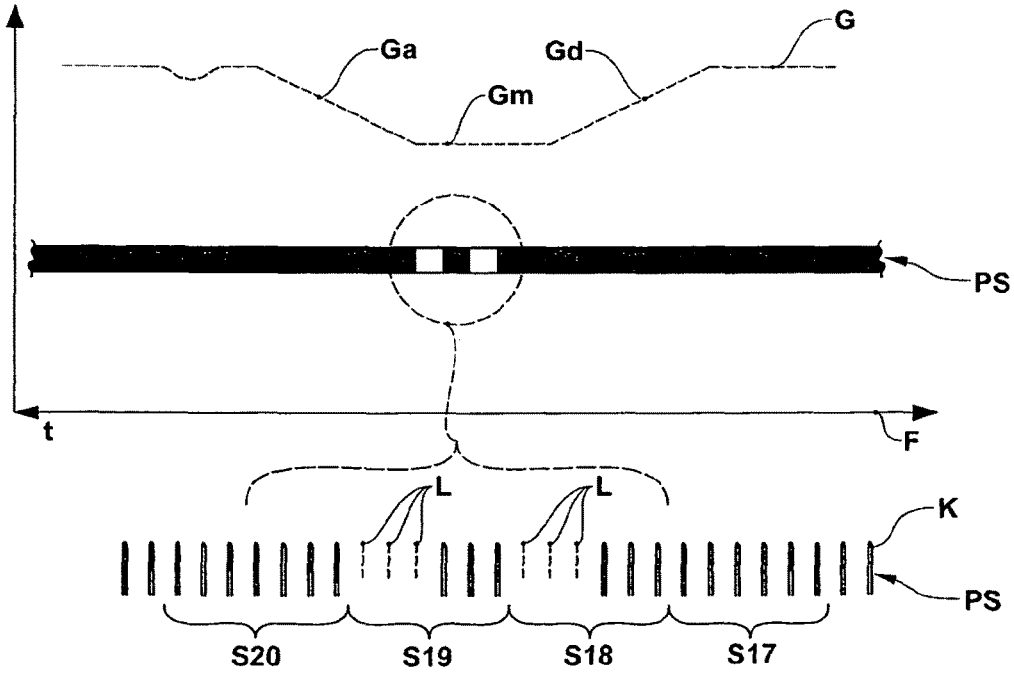
FIG. 3*b* shows a graph in which, based on the stack sizes according to FIG. 3*a*, the production speed of the print further processing system and of the corresponding product stream fed to the stacking device and having empty product positions is illustrated as horizontal bars and in a schematic enlargement of a detail.

This is to be illustrated and described briefly by using FIGS. 3*a* and 3*b*. FIG. 3*a* once more shows a sequence of product stacks S of different size which, for example, are to be produced with a stacking device 60 as shown in FIG. 1. While the first five product stacks S10 to S14 are of standard size, the three following stacks S15 to S17 each comprise one product, less than the standard stacks S10-S14 with the maximum size. In order to give the stacking device sufficient time to produce the stacks S15 to S17 of reduced stack size, as indicated dashed by curve G in FIG. 3*b*, the system speed G is reduced. Since the two following stacks S18 and S19 once more each comprise three products fewer, the system speed G is reduced still further down to a local minimum Gm along the ramp Gd during the production of the stacks S15 to S17. Since the reduction in the system speed is not sufficient to produce the part packs S18 and S19, empty positions have previously been inserted into the stream of product collections PS supplied. In FIG. 3*b*, the product stream PS is shown as a bar. The black regions symbolise an uninterrupted product stream; the empty positions are indicated as white blocks. In order to be able to produce the part packs S18 and S19, in each case three empty positions L have been inserted between the collections K into the product stream PS in the associated sections for the part packs S18 and S19. With the exception of these empty positions L, the product stream PS is complete and interruption-free. Since the stacks S20 to S22 are once more of full size, the system speed G can be increased up to the maximum value with the maximum slope Ga following the production of the part stacks S18 and S19. A following stack S23 with a size reduced by one product can in turn be produced with a small reduction in the system speed G without it being necessary to insert empty positions into the product stream PS.

While, in the examples described hitherto, the threshold value T was in each case a predefined value of the difference Δ in the size of successive packs (Sn−Sn+1), in further advantageous embodiments of the method according to the invention, the threshold value can be a predefined value of a difference Δ' of the mean value formed from the sizes of groups of a number of successive packs. These groups preferably comprise two to four packs, particularly preferably 3 packs, and are calculated in an overlapping manner. This means that the first mean value is, for example, formed on the basis of three successive packs 1-3. The next mean value is calculated on the basis of the sizes of the packs 2-4, etc.

Figure 4:
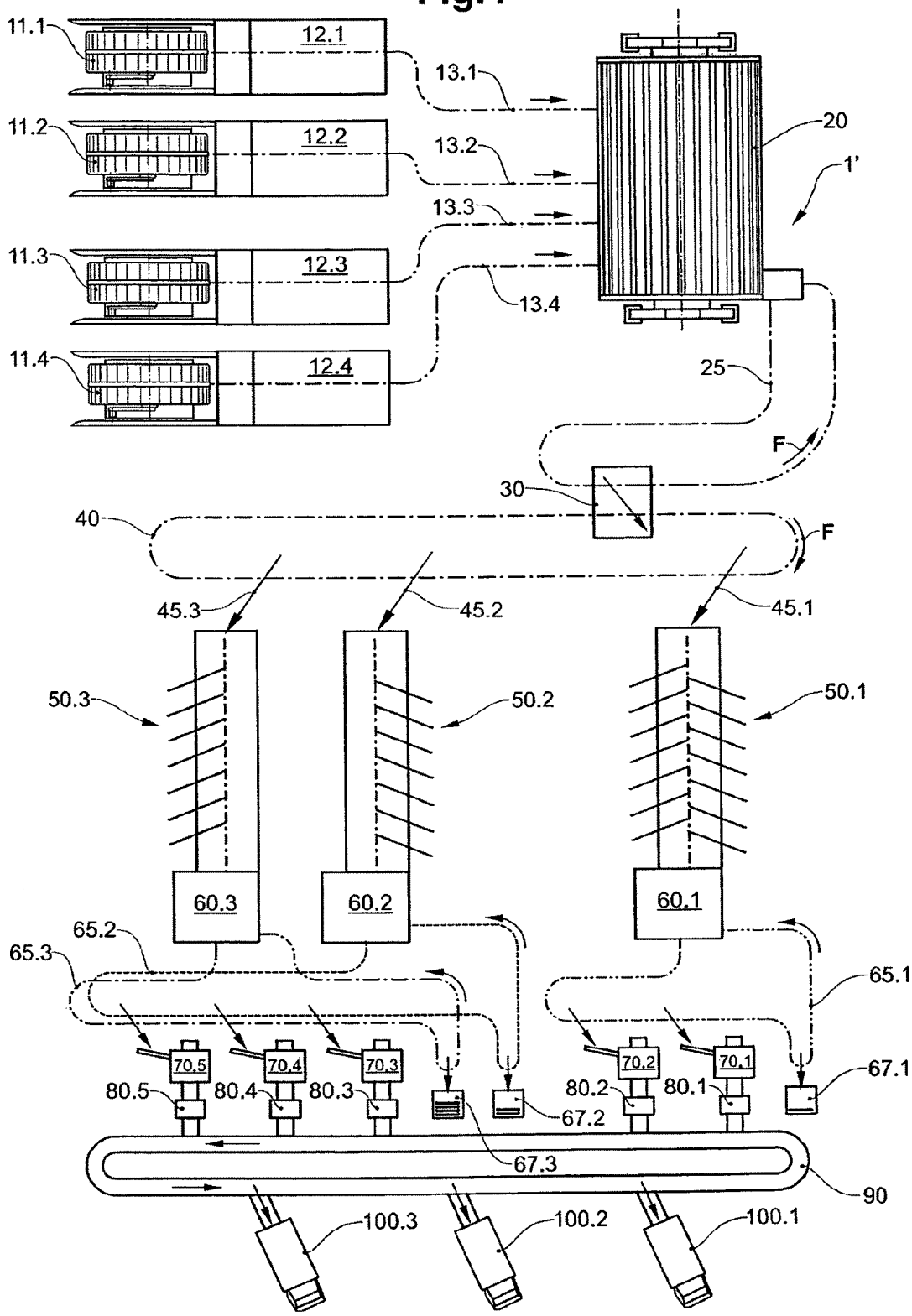
FIG. 4 shows a highly schematic view of a print further processing system according to a further embodiment.

In the exemplary embodiment illustrated in FIG. 4, one of three collating apparatuses is intended to produce part packs. The collating apparatus 50.1, which performs the production of the part packs, has the two stacking apparatuses 70.1 and 70.2 connected downstream. The two collating apparatuses 50.2 and 50.3 having the three stacking apparatuses 70.3, 70.4 and 70.5 connected and arranged downstream are used for producing standard packs.

In the embodiment of a print further processing system 1' according to the invention according to FIG. 4, an insertion drum 20 is supplied with a main product and three pre-products via four feed conveyors 13.1 to 13.4. In the insertion drum 20 downstream, three pre-products from the storage drums 11.2, 11.3 and 11.4 are inserted into the main product, which, in off-line operation, is fed to the insertion drum from a storage drum 11.1 via a cyclic feeder 12.1 and the feed conveyor 13.1. This procedure is carried out in a known way in synchronism with the higher-order system cycle rate. Those skilled in the art know how; by means of various system components, more complex printed products can be produced which comprise a desired number of pre-products and/or inserts, which are bonded or stitched or are stuck into the cards, DVDs or the like. The printed products produced in the insertion drum 20 are delivered via a gripper conveyor 25 and are transferred to a circulator 40 at a transfer station 30. In the exemplary embodiment illustrated, the circulator 40 supplies three collating apparatuses 50.1, 50.2 and 50.3 each having stacking apparatuses 70.1-70.5 connected downstream with the printed products produced in the insertion drum 20, in each case via a transporter 45:1, 45.2, 45.3.

Each of the collating apparatuses 50.1 to 50.3 illustrated has a station 60.1 to 60.3 connected downstream for film-wrapping the product collections put together. Deliverers 65.1 to 65.3, for example in the form of circulating chain conveyors with grippers, pick up the product collections wrapped in film and feed them to the respectively associated stacking apparatuses. In the example illustrated, the deliverer 65.1 supplies the two stacking apparatuses 70.1 and 70.2 arranged serially one after the other with product collections for producing the part packs. The deliverers 65.2 and 65.3 pick up the products from the respective film-wrapping stations 60.2 and 60.3 and feed them to the stacking apparatuses 70.3, 70.4 and/or 70.5. In the embodiment illustrated, the deliverers 65.2 and 65.3 are formed in such a way that all three stacking apparatuses 70.3, 70.4 and 70.5 can be supplied with product collections by both deliverers 60.2 and 60.3. Each of the deliverers 65.1, 65.2 and 65.3 is equipped, downstream of the stacking apparatuses 70.1 to 70.5 supplied by it, with an overflow 67.1, 67.2, 67.3 in each case, into which excess or damaged product collections or those that cannot currently be processed can be discharged.

The stacks of end products or product collections produced in the stacking apparatuses 70.1 to 70.5 are tied up or banded to form packs in binders 80.1 to 80.5 connected directly downstream of the stacking apparatuses 70.1 to 70.5. They are then discharged onto a circulating pack transporter 90, which conveys them to the transport vehicles 100.1, 100.2 and 100.3 provided in accordance with the production plan.

Only in FIG. 1 are connections between the individual parts of the system and the higher-order computerized control system 2 illustrated. In principle, it is true that these connections can be formed in a wired or line-bound or wireless or line-free manner. This is likewise indicated in FIG. 1, in which the overflow 67 is connected to the control system 2 in a wire-free manner by a radio connection.

By using the schematic illustration of the product sequences in FIG. 5, the production and the division of the superimposed product sequence in accordance with the present invention is to be explained in more detail below. The method sequence illustrated can proceed, for example, from a print further processing system 1' as illustrated in FIG. 4. From three off-line product stores, not illustrated further, a main product (symbolized by a square) and two pre-products (symbolized by a triangle and a circle) are fed to an insertion drum 21. In accordance with the production plan 10, in each system cycle a main product and a pre-product of both types in each case can be inserted. The filled symbols indicate that, in the respective working cycle, a previously extracted product is inserted into the drum 21. In the cycle 10.1, a first main product ■ is inserted into the drum and conveyed as far as a next insertion position. This insertion position is located in a next section of the drum located downstream, where a first pre-product is inserted into the main product. It is clear to those skilled in the art that the sequences of main and pre-products in the production plan 10 and, respectively, in the cycles 10.1-10.4 are illustrated highly simplified in FIG. 5, since the products located in between in each case are not shown. Between the insertion of the main product and the insertion of the first pre-product there is a large number of cycles, since the main product runs through a complete drum rotation before it arrives at the insertion position for the first pre-product. The two unfilled symbols for the two pre-products in cycle 10.1 symbolize the fact that no part products are inserted in this cycle 10.1. In actual fact, cycle 10.2 of course does not follow cycle 10.1 directly but only after a number of cycles which corresponds to the number of holders along the circumference of the drum. In working cycle 10.2, the first main product has reached the insertion position of the first pre-product. A further main product ■ is inserted in the first section of the drum and, at the same time, in the second section, a first pre-product ▲ is inserted into the first main product ■ previously fed in the working cycle 10.1. In the following working cycle 10.3, the first main product with the first pre-product already inserted is completed with a second pre-product ● to form the first printed product. In this working cycle, a first pre-product ▲ is inserted into the following second main product. The cycle position 10.3 for the main product remains empty, which means that no main product has previously been extracted for this cycle position. The cycle position 10.3 for the main product, just like the following cycle position 10.4 for the first pre-product and the cycle position 10.5 for the second pre-product in the production plan, is allocated to the product sequence as an empty position for the production of a part pack.

While the first and the second completed printed product P1, P2 in the present exemplary embodiment are fed in downstream of the first and second collating apparatuses 51.2 and 51.3 for the production of standard packs, the empty positions in the working cycles 10.3, 10.4 and 10.5 lead to an empty position P3 following the two completed printed products in the superimposed product sequence. The appropriately produced superimposed product sequence is indicated as an extract in a circulating conveyor 41. In this superimposed product sequence, three product sequences for the supply of three stacking apparatuses or, respectively, the three collating apparatuses 51.1-51.3 are combined. The products P1, P4 and P7 belong to the same product sequence, which is assigned to the collating apparatus 51.3. The products P2, P5 and P8 belong to a second product sequence, which is likewise used to produce standard packs and is assigned to the collating apparatus 51.2. And the products P3, P6 and P9 belong to a further product sequence, which supplies the collating apparatus 51.1 and the stacking apparatus connected downstream for producing part packs. The unfilled product symbols in the product positions P3 and P6 indicate that there are no products present on the circulating conveyor 41 at the corresponding positions, for example in the corresponding gripper clamps. When the corresponding product position reaches the transfer point 46.1, no printed product is transferred to the collating apparatus 51.1. With the transfer of the printed products to the collating apparatuses connected upstream of the stacking apparatuses, the superimposed product sequence in the exemplary embodiment illustrated is resolved into the three individual product sequences of the collating apparatuses.

By using the symbolically illustrated collating apparatuses 51.1, 51.2 and 51.3, these individual product sequences are illustrated at an appropriately later time in the production sequence. In the two collating apparatuses 51.2 and 51.3, product sequences for the production of standard stacks S32, S33 are further processed. In the collating apparatus 51.2, the further inserts A and B are added to the printed products ■ ▲ ●. In the collating apparatus 51.2, the same printed products ■ ▲ ● are likewise put together with the insert A and, differently, with the insert C to form collections ■ ▲ ●AC, for example for another delivery area.

Figure 5:
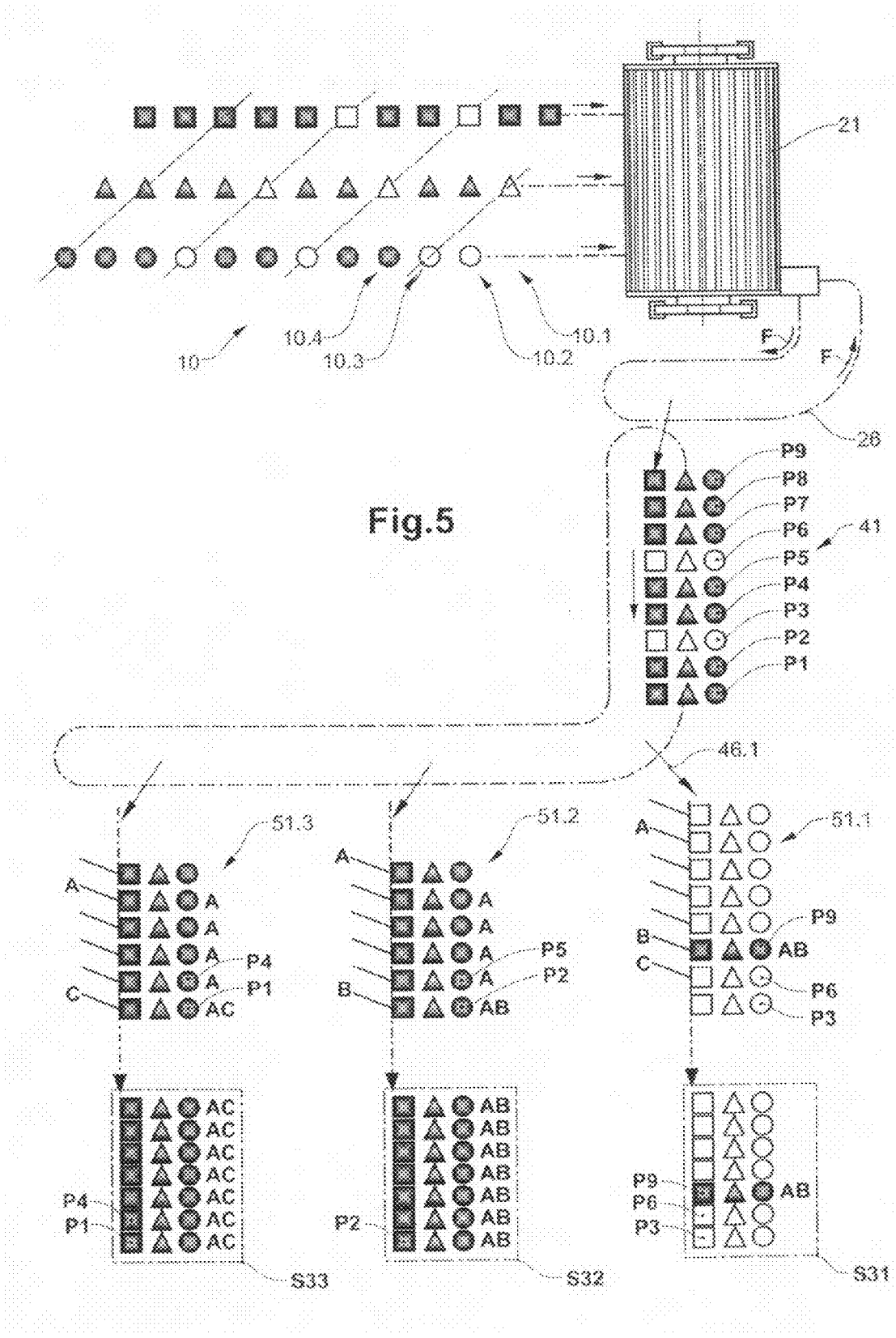
FIG. 5 shows an overview which illustrates a further example of the production of a superimposed product sequence for the supply of three collating apparatuses with stacking apparatuses connected downstream in each case, two serving to produce standard packs and one to produce part packs, and the composition of the respective product collections being indicated.

In the collating apparatus 51.1, in the example illustrated according to FIG. 5, the further inserts A and B are likewise added to the printed products ■ ▲ ●. Product collections of the same type ■ ▲ ●AB are therefore produced as in the collating apparatus 51.2. Since, apart from the product position P9, the preceding and following product positions remain empty, a part pack S31, which comprises only a single product collection of the type ■ ▲ ●AB, is produced in the stacking apparatus arranged downstream—but not illustrated in the figure.

In FIG. 5, it is already indicated that the collating apparatus 51.1 is equipped with a plurality of feeders. In concrete terms, it is shown that inserts of the type A, B and C can be added to the printed products supplied. If required, by using the collating apparatus 51.1, i.e. at any time, product collections for part packs of the type ■ ▲ ●AC can also be produced, for which the product collections for the standard packs are produced on the collating apparatus 51.3.

Figure 6:
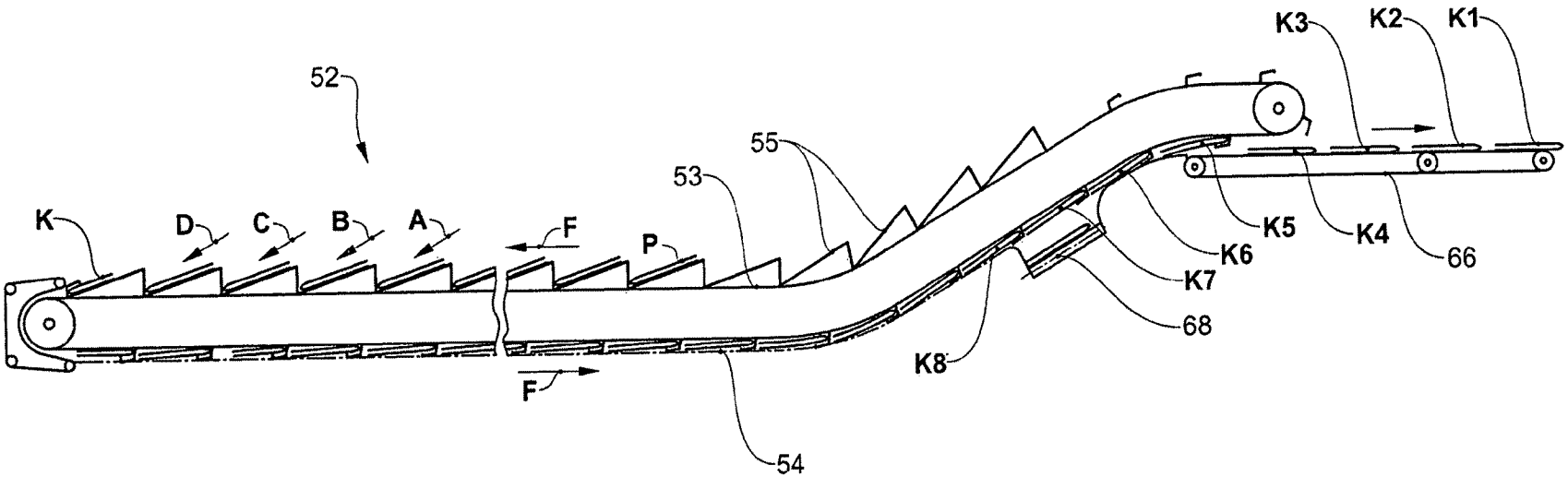
FIG. 6 shows a side view of a collating device for use in print further processing systems according to FIG. 1 or 4 according to a further embodiment of the method of the invention.

FIG. 6 illustrates a side view of a collating device for use in a print further processing system according to FIG. 1, as is known for example from WO2010/051651 and with the aid of which a method according to a further embodiment can be carried out The collating apparatus 52 illustrated permits the production of collections K of printed products P and inserts A, B, C, D along a collating section. The collating is carried out in a known way on an upper run 53 having a multiplicity of holders 55, in which the product collections K can be put together, transported in the conveying direction F and held in a clamping manner for the transport along the lower run 54. At the end of the lower run 54, the product collections can be discharged to a deliverer or held and fed to the upper run again. In the example illustrated, the collections K1 to K4 are delivered and fed to a stacking device connected downstream but not illustrated in the figure. The following product collections K5 to K8 are not discharged but fed back and, as a result, permit the stacking device connected downstream to be fed with a product sequence of four complete collections K1-K4 and then four empty product positions and the formation of a part pack with four collections instead of a standard pack with eight collections in this case. In the superimposed product sequence, account must be taken of the feedback. For the four collections fed back, it must be ensured that, as they run through the upper run 53 again, they are not populated with products and/or inserts again. In the superimposed product sequence, as it is supplied in the circulator not illustrated in the figure, the empty positions for these four collections K5 to K8 that are fed back must be displaced appropriately towards the rear. By feeding back product collections that have already been put together correctly, sufficient time can thus be created, by the generation of empty cycle positions, for the at least one stacking apparatus connected downstream to produce part packs without collections having to be removed in the rejects removal 68. The sequence present in the deliverer 66 is in this case not already present in identical form in the superimposed product sequence or, respectively, in the product sequence for the production of part packs separated from the superimposed product sequence. One advantage of this procedure resides in the fact that the decision as to whether to produce a part pack and therefore to form preceding empty positions can be moved closer in process engineering terms to the stacking apparatus.

I claim:

1. A method for operating a print further processing system (1, 1') for producing and processing printed products, in particular of printed product collections from completed final printed products such as periodicals and newspapers, the method comprising:

putting together a main product and a plurality of part products and/or inserts, wherein the printed products are produced in accordance with a predefined production plan;

processing the printed products with a stacking device (70, 70.1-70.5) to form a sequence of packs (S) of individually predefined size, in order to produce part packs;

reducing the processing speed of at least one of a collating apparatus, a circulator, an insertion drum and a feed conveyor of the print further processing system (1, 1') that are connected upstream of the stacking device (70, 70.1-70.5), when a threshold value (T) is exceeded, in order to adapt to the processing capacity of the stacking device (70, 70.1-70.5); and forming empty positions (L) under control in a section of the product sequence allocated to the pack (S).

2. The method according to claim 1 wherein the threshold value (T) is a predefined value of the difference Δ in the size of successive packs (Sn−Sn+1).

3. The method according to claim 2 wherein the successive packs comprise groupings of successive packs.

4. The method according to claim 2 further comprising:

splitting a superimposed product sequence into individual product sequences during at least one of feeding to associated stacking apparatuses and collating apparatuses connected upstream of the latter.

5. The method according to claim 2 further comprising:

generating empty positions in a superimposed product sequence in the specific product sequence for the delivery to the stacking device (70.1, 70.2) for producing part packs (S1, 2).

6. The method according to claim 2 further comprising:

connecting an apparatus which has the ability to feed back collated product collections upstream of the stacking device for producing part packs.

7. The method according to claim 2 further comprising:

connecting a deliverer of the collating apparatus which has the ability to feed back collated product collections within the deliverer upstream of the stacking device for producing part packs.

8. The method according to claim 2 further comprising:

taking into account the feeding back of product collections in the collating apparatus or in a deliverer in control terms in the product sequence for the part pack production and in a superimposed product sequence.

9. The method according to claim 1 wherein the threshold value (T) is a predefined value of the difference Δ in the size of the mean values for groups of successive packs.

10. The method according to claim 9 further comprising:

taking into account the feeding back of product collections in the collating apparatus or in a deliverer in control terms in the product sequence for the part pack production and in a superimposed product sequence.

11. The method according to claim 1 further comprising:

splitting a superimposed product sequence into individual product sequences during at least one of feeding to associated stacking device and collating apparatus connected upstream thereof.

12. The method according to claim 1 further comprising:

generating empty positions in a superimposed product sequence in the specific product sequence for the delivery to the stacking device (70.1, 70.2) for producing part packs (S1, 2).

13. The method according to claim 1 further comprising:

connecting an apparatus which has the ability to feed back collated product collections upstream of the stacking device for producing part packs.

14. The method according to claim 1 further comprising:

connecting a deliverer of a collating apparatus which has the ability to feed back collated product collections within the deliverer upstream of the stacking device for producing part packs.

15. A print further processing system (1) for implementing the method according to claim 1.

16. The print further processing system (1) according to claim 15, further comprising:

a computerised control system which is designed to be wire-bound or line-bound or wire-free or line-free, the system being connected indirectly or directly to the computerised control system.

* * * * *